US008128371B2

(12) United States Patent
Ravi et al.

(10) Patent No.: US 8,128,371 B2
(45) Date of Patent: Mar. 6, 2012

(54) METHOD AND APPARATUS TO FACILITATE INCREASING TURBINE ROTOR EFFICIENCY

(75) Inventors: Srinivas Ravi, Simpsonville, SC (US); Robert Crag Akin, Greer, SC (US); Richard Francis Gutta, Greer, SC (US); Roger Clayton Walker, Piedmont, SC (US); Fernando Casanova, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1668 days.

(21) Appl. No.: 11/675,390

(22) Filed: Feb. 15, 2007

(65) Prior Publication Data

US 2008/0196247 A1 Aug. 21, 2008

(51) Int. Cl.
*F01D 5/32* (2006.01)

(52) U.S. Cl. ..... 416/212 R; 416/212 A; 416/214 R; 416/214 A; 416/219 R; 416/220 R

(58) Field of Classification Search ..... 416/212 R, 416/212 A, 214 R, 214 A, 219 R, 220 R
See application file for complete search history.

(56) References Cited

U.S. PATENT DOCUMENTS 2,998,959 A * 9/1961 Moss et al. ..... 416/221
3,096,074 A 7/1963 Pratt et al.
3,137,478 A 6/1964 Farrell
3,397,865 A 8/1968 Catlow et al.
3,572,966 A * 3/1971 Borden et al. ..... 416/95
3,656,865 A 4/1972 Spears, Jr.
3,807,898 A 4/1974 Guy et al.
3,887,298 A 6/1975 Hess et al.
3,936,222 A 2/1976 Asplund et al.
4,021,138 A * 5/1977 Scalzo et al. ..... 416/95
4,108,571 A 8/1978 Mawson
4,344,740 A * 8/1982 Trenschel et al. ..... 416/221
4,439,107 A 3/1984 Antonellis
4,470,757 A 9/1984 Vollinger
4,523,890 A 6/1985 Thompson
4,659,285 A 4/1987 Kalogeros et al.
4,781,534 A 11/1988 Ferleger
4,854,821 A * 8/1989 Kernon et al. ..... 416/95
5,173,024 A * 12/1992 Mouchel et al. ..... 416/220 R
5,211,407 A 5/1993 Glynn et al.
5,256,035 A 10/1993 Norris et al.
5,275,534 A * 1/1994 Cameron et al. ..... 416/95
5,318,405 A * 6/1994 Meade et al. ..... 416/220 R
5,445,499 A 8/1995 Charbonnel
5,954,477 A * 9/1999 Balsdon ..... 416/95
5,993,160 A 11/1999 Bouchard et al.
6,106,234 A * 8/2000 Gabbitas ..... 416/221
6,499,945 B1 12/2002 Lathrop
7,264,448 B2 * 9/2007 Garner ..... 416/212 R
7,334,983 B2 * 2/2008 Alvanos et al. ..... 415/115

* cited by examiner

*Primary Examiner* — Igor Kershteyn
(74) *Attorney, Agent, or Firm* — Armstrong Teasdale LLP

(57) ABSTRACT

A method facilitates assembling a turbine. The method includes coupling buckets to a turbine wheel. The method also includes coupling a first end of a cover plate to the turbine wheel such that at least one projection extending from the turbine wheel retains the cover plate in position relative to the turbine wheel and inserting a fastening mechanism through an opening defined in the turbine wheel to secure the cover plate against the turbine wheel. The cover plate facilitates reducing dovetail leakage across the buckets coupled to the turbine wheel.

18 Claims, 7 Drawing Sheets

METHOD AND APPARATUS TO FACILITATE INCREASING TURBINE ROTOR EFFICIENCY

BACKGROUND OF THE INVENTION

This invention relates generally to turbine rotors, and, more specifically, to a cover plate for use with a turbine rotor to facilitate reducing dovetail leakage through the turbine wheel.

At least some known turbines include wheel assemblies coupled to rotors. Known wheel assemblies include a turbine wheel with a plurality of retaining slots defined therein that are sized and shaped to receive a turbine bucket, or blade, therein such that the buckets, or blades, are coupled to the wheel, and extend radially outward from the wheel. Within at least some known wheels, a gap may exist between the buckets and retaining slots. During turbine operation, fluid can leak through the gap rather than flow through the buckets and/or nozzle area. Such leakage is generally uncontrolled and decreases the overall turbine efficiency.

To facilitate reducing dovetail leakage, at least some turbine buckets include a coating put on the bucket dovetails to reduce uncontrolled leakage through the gaps. Although the coating reduces the size of the gap in operation, such coatings do not adequately control leakage. Moreover, such coatings may wear permanently when the turbine is on turning gear. Other known rotor assemblies include circumferential seals or sheet metal cover plates. However, such components generally provide only marginal turbine efficiency improvements.

BRIEF DESCRIPTION OF THE INVENTION

In one aspect, a method of assembling a turbine is provided. The method includes coupling buckets to a turbine wheel. A cover plate is coupled to the turbine wheel by coupling a first end of a cover plate to the turbine wheel such that at least one projection extending from the turbine wheel retains the cover plate in position relative to the turbine wheel. A fastening mechanism is inserted through an opening defined in the turbine wheel to secure the cover plate against the turbine wheel. The cover plate facilitates reducing dovetail leakage across the buckets coupled to the turbine wheel, which is adjacent to the cover plate.

In another aspect, a turbine is provided. The turbine includes a plurality of buckets each having a dovetail. The turbine also includes a turbine wheel that includes a plurality of retaining slots defined therein. Each of the retaining slots is sized to receive each of the bucket dovetails therein. The turbine wheel further includes at least one projection extending outward from the turbine wheel. At least one cover plate is coupled to the turbine wheel such that the projection retains the cover plate in position against the turbine wheel. At least one fastening mechanism is inserted through an opening defined in the turbine wheel to secure the cover plate to the turbine wheel such that the cover plate facilitates reducing dovetail leakage across the buckets adjacent to the cover plate.

In a further aspect, a wheel assembly for use with a turbine is provided. The wheel assembly includes a turbine wheel with a plurality of retaining slots defined therein and at least one projection. Each of the plurality of slots is sized to receive a turbine bucket therein. At least one projection extends outward from the turbine wheel and includes at least one opening extending therethrough. The wheel assembly further includes at least one cover plate configured to couple to the turbine wheel such that at least one projection retains at least one cover plate in position against the turbine wheel. At least one fastening mechanism sized for insertion through the opening to secure the at least one cover plate against the turbine wheel. In this position the cover plate extends across at least one of said plurality of retaining slots.

DETAILED DESCRIPTION OF THE INVENTION

Figure 1:
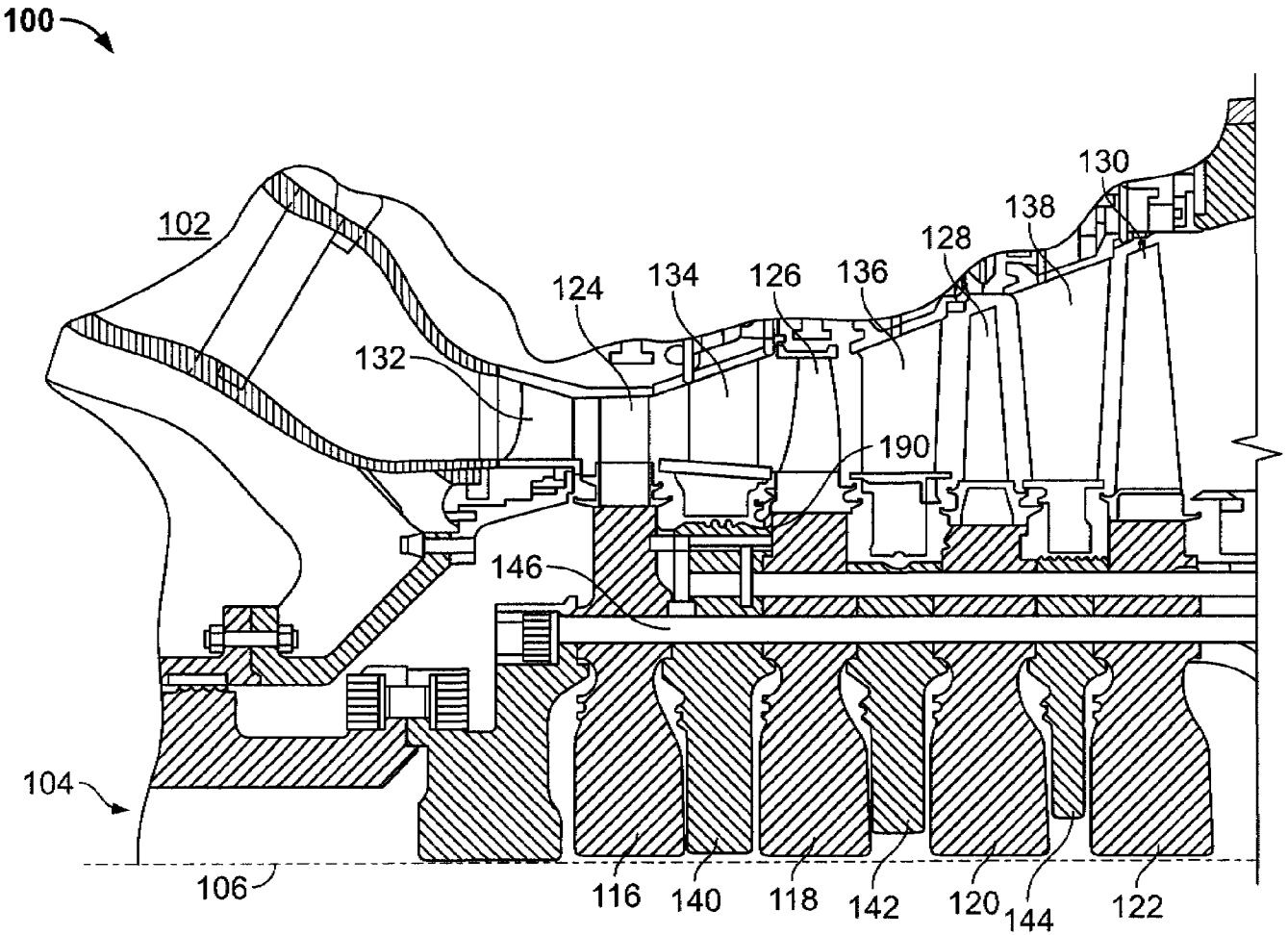
FIG. 1 is a schematic view of a portion of an exemplary turbine rotor assembly.

FIG. 1 is a schematic view of a portion of a turbine rotor assembly. In the exemplary embodiment, turbine rotor assembly 100 is used with a gas turbine, and rotor assembly 100 is downstream of a combustor 102. Assembly 100 includes a rotor 104 that rotates about an axis of rotation 106. In the exemplary embodiment, rotor assembly 100 includes four successive stages of turbine wheels 116, 118, 120 and 122. Alternately, assembly 100 may include more or less than four stages. Turbine wheels 116, 118, 120 and 122 are each coupled together to form part of rotor 104 such that turbine wheels 116, 118, 120 and 122 rotate concurrently with rotor 104 during turbine operation.

Each wheel 116, 118, 120 and 122 includes a row of buckets or blades (hereinafter referred to as buckets) 124, 126, 128 and 130 that are spaced circumferentially about it. Between each row of buckets 124, 126, 128 and 130 are rows of stationary nozzles 132, 134, 136 and 138 and between each of the wheels 116, 118, 120 and 122 are spacers 140, 142 and 144. More specifically, spacers 140, 142 and 144 are radially inward from, and oppose, the rows of nozzles 134, 136 and 138. The spacers 140, 142 and 144 are secured to wheels 116, 118, 120 and 122 via a plurality of fasteners 146, such as bolts, that are spaced circumferentially about rotor 104 and wheels 116, 118, 120 and 122. In operation, as wheels 116, 118, 120 and 122 rotate, spacers 140, 142 and 144 facilitate maintaining wheels 116, 118, 120 and 122 in position between the rows of nozzles 134, 136 and 138.

Figure 2:
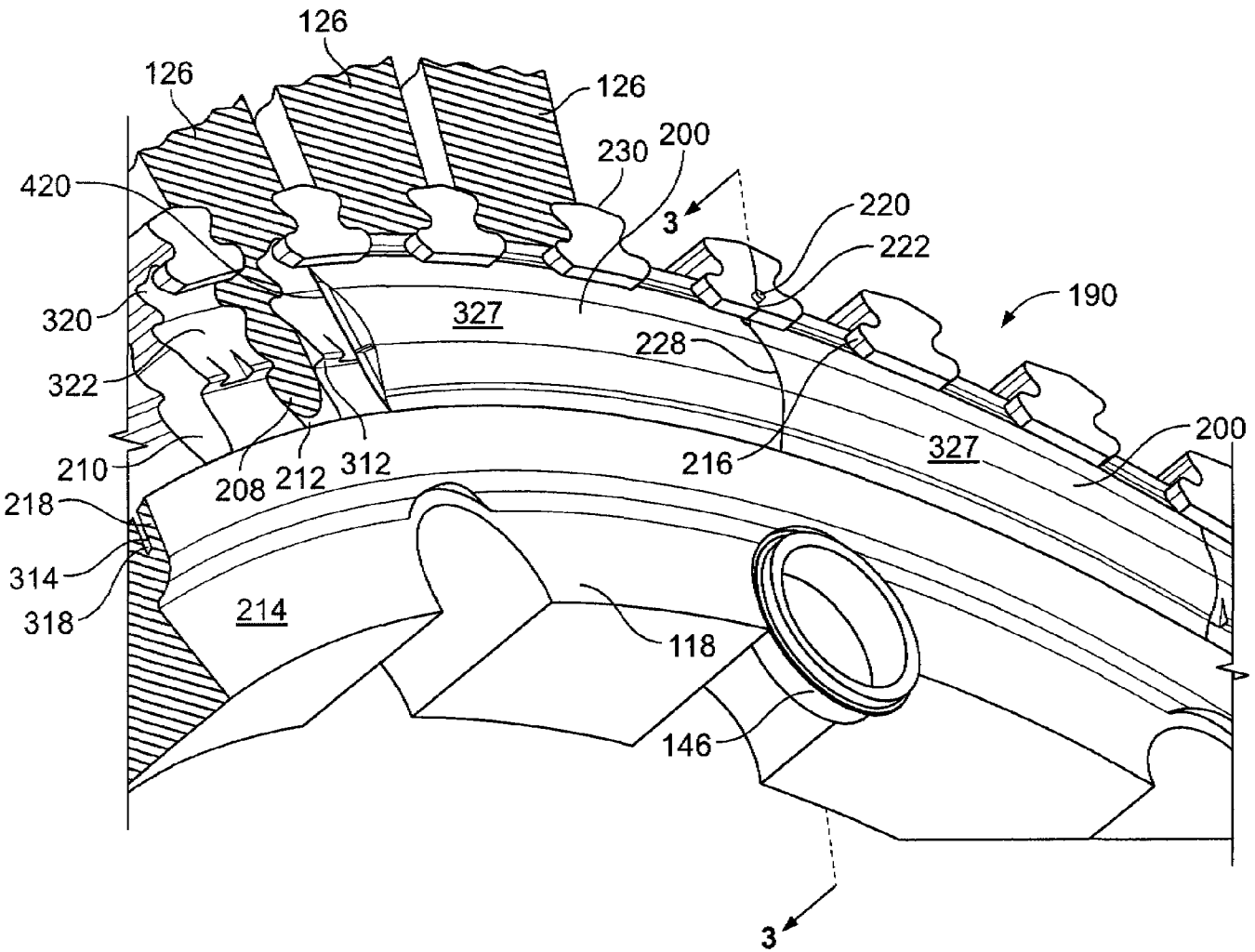
FIG. 2 is a perspective view of a cover plate assembly that may be used with the rotor assembly shown in FIG. 1.
Figure 3:
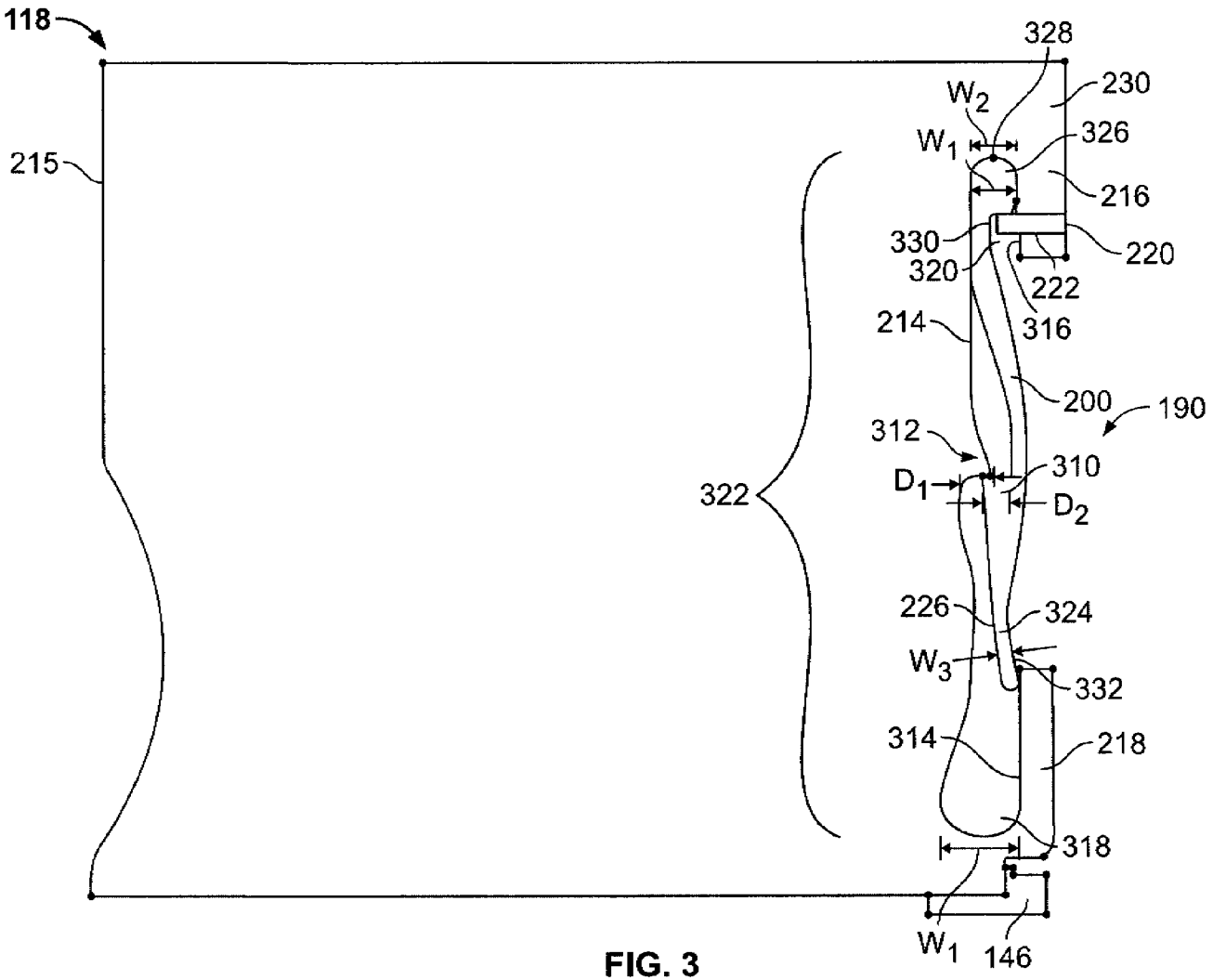
FIG. 3 is a cross-sectional view of the rotor assembly and cover plate assembly shown in FIG. 2 and taken along line 3-3.
Figure 4:
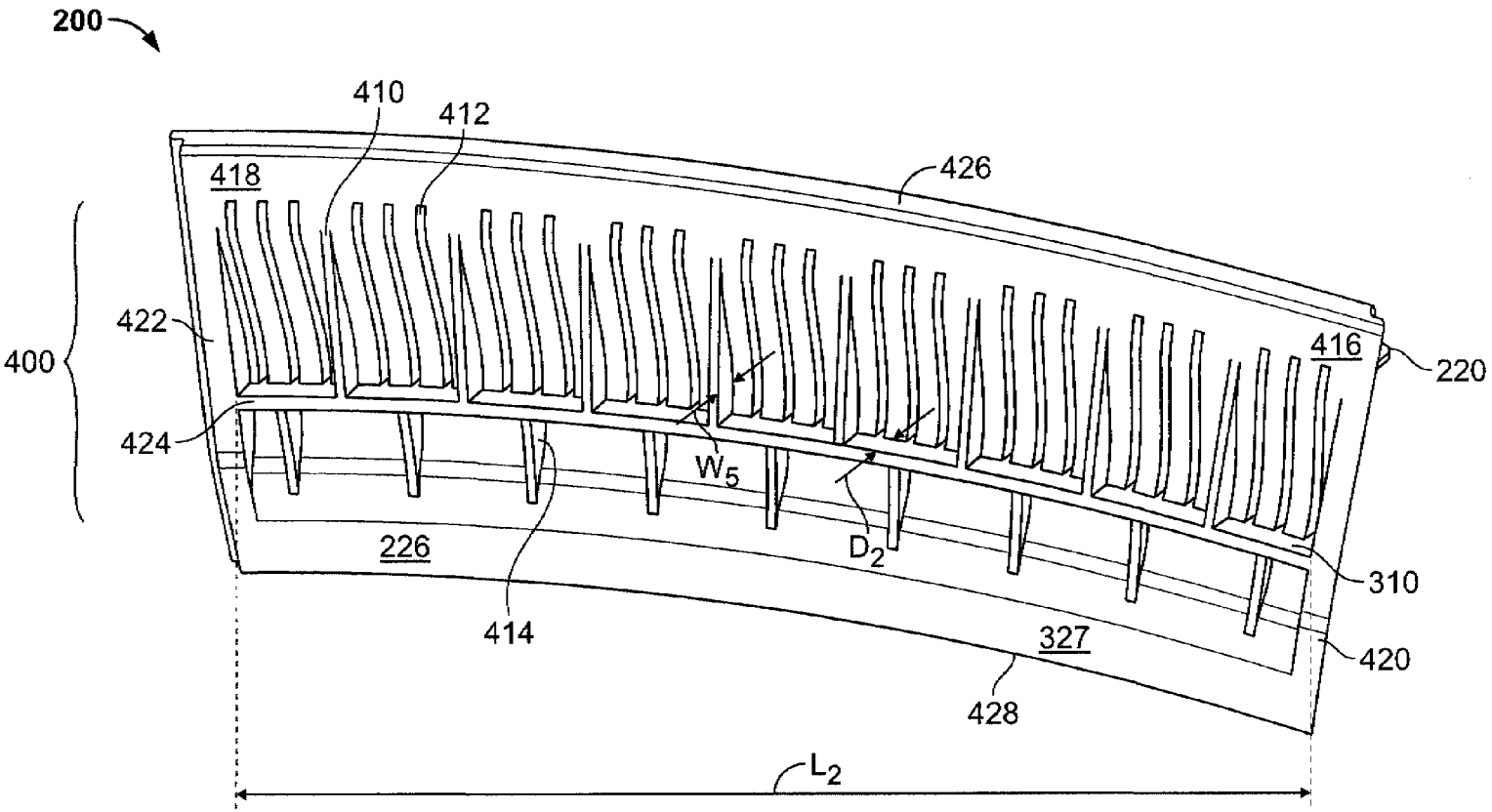
FIG. 4 is a perspective view of an inner surface of the cover plate shown in FIG. 3.

FIG. 2 is a perspective view of an exemplary cover plate assembly 190 that may be used with turbine rotor assembly 100. FIG. 3 is a cross-sectional view of cover plate assembly 190. FIG. 4 is a perspective view of a cover plate 200 used with cover plate assembly 190. Although illustrated as being coupled to wheel 118, it shall be appreciated by one of ordinary skill in the art that cover plate 200 could be installed on, but is not limited to only being used with, any of wheels 116, 118, 120 or 122.

Wheel 118 includes a plurality of buckets 126 coupled within a plurality of retaining slots 210 defined within wheel 118. Specifically, each slot 210 is sized and shaped to receive a bucket 126 therein. Wheel 118 includes dovetail posts 230 that extend radially outward from and are integrally formed with wheel 118. Dovetail posts 230 are spaced circumferentially about wheel 118 such that each dovetail post 230 is positioned between a pair of circumferentially adjacent buckets 126 coupled to wheel 118. In the exemplary embodiment, each dovetail post 230 includes a projection 216 that extends inward from wheel 118 such that an outer retaining groove 320 in defined by projection 216, as described below. More specifically, each bucket 126 includes a dovetail portion 208 that is inserted within one of the retaining slots 210, such that the bucket 126 is securely coupled to wheel 118. For example, in an exemplary embodiment, each bucket dovetail portion 208 is generally "fir-tree" shaped, and each slot 210 is shaped with a correspondingly fir-tree shaped recess.

Although the shape of dovetail portions 208 and slots 210 are substantially similar, after each bucket 126 is coupled to rotor assembly 100, generally a gap 212 is defined between each bucket dovetail 208 and retaining slot 210. In an exemplary embodiment, cover plate assembly 190 is coupled to rotor assembly 100, as described herein, such that each cover plate 200 extends across each gap 212. More specifically, in the exemplary embodiment, a plurality of cover plates 200 are coupled together end-to-end such that cover plates 200 extend substantially circumferentially against one of an upstream surface 214 and a downstream surface 215 of turbine wheel 118.

In the exemplary embodiment, wheel 118 includes projections 216 and a plurality of retainers 218. Projections 216 and retainers 218 are spaced radially apart on an upstream surface 214 of wheel 118. More specifically, in the exemplary embodiment, projection 216 is formed integrally with wheel 118 and extends outward from wheel 118 such that a radially outer retaining groove 320 is defined between an inner surface 316 of projection 216 and wheel upstream surface 214. Moreover, in the exemplary embodiment, retainer 218 is also formed integrally with wheel 118 and extends outward from wheel 118 such that a radially inner retaining groove 318 is formed. Alternatively, projection 216 and/or retainer 218 may be formed integrally with each of buckets 126 and with wheel 118. In another embodiment, projection 216 and/or retainer 218 may be formed integrally with each of buckets 126 and not with wheel 118. Retaining grooves 318 and 320 each have a width $W_1$ and $W_2$, respectively, and in the exemplary embodiment, grooves 318 and 320 are aligned generally radially. More specifically, a retaining channel 322 extends from radially inner retaining groove 318 to radially outer retaining groove 320. Cover plate 200 is retained within retaining channel 322, as described below.

In the exemplary embodiment, within retaining channel 322, wheel 118 includes a shelf 312 that is formed integrally on wheel upstream surface 214. More specifically, shelf 312 has a length $L_1$, measured circumferentially along wheel upstream surface 214 and a depth $D_1$, measured axially outward from wheel upstream surface 214. In the exemplary embodiment, length $L_1$ is such that shelf 312 extends only across a portion of wheel 118, and more specifically, only partially between adjacent retaining slots 210.

In the exemplary embodiment, cover plate assembly 190 includes at least one cover plate 200 and at least one fastening mechanism 220 that is sized to be received in an opening 222 defined in turbine wheel 118. Cover plate 200 includes a radially inner end 324, a radially outer end 326, and a body 327 extending therebetween. Cover plate ends 324 and 326 each have a width $W_3$ and $W_4$, respectively, that is sized to enable respective cover plate ends 324 and 326 to be inserted within radial retaining grooves 318 and 320, respectively. More specifically, in the exemplary embodiment, width $W_3$ is narrower than widths $W_1$ and $W_4$, and width $W_4$ is narrower than width $W_2$. Furthermore, in the exemplary embodiment, cover plate 200 is formed integrally with a ledge 310 on an inner surface 226 of cover plate 200. In the exemplary embodiment, inner surface 226 is formed at least partially concave and has a depth D2. Moreover, ledge 310 has a length $L_2$ that extends circumferentially at least partially along inner surface 226. Ledge depth $D_2$ enables ledge 310 to extend axially outward from inner surface 226. In the exemplary embodiment, length $L_2$ extends between circumferentially adjacent shiplap tabs 420, 422 formed on each circumferential end 416, 418 of cover plate 200. Fastening mechanism 220 is inserted through opening 222 to secure cover plate 200 to wheel 118. In the exemplary embodiment, opening 222 extends through projection 216, which extends from and is formed integrally with dovetail post 230. Moreover, in the exemplary embodiment, fastening mechanism 220 is a threaded bolt. It will be appreciated by one in the art that any suitable coupling mechanism or component, such as a bolt, a screw, a pin, an axial bolt, a stud, or a threaded rod, may be used as fastening mechanism 220. Welding may also be used as fastening mechanism 220; however, using retention hardware facilitates subsequent cover plate assembly 190 disassembly for maintenance or other purposes.

Cover plate assembly 190 is secured to wheel 118 in retaining channel 322 by initially inserting a portion of cover plate radially inner end 324 into a portion of radially inner retaining groove 318. Cover plate radially outer end 326 is slidably inserted into radially outer retaining groove 320 such that ledge 310 contacts shelf 312. More specifically, in the exemplary embodiment, when outer end 326 is slidably inserted into outer retaining groove 320, cover plate ledge 310 engages wheel shelf 312 such that cover plate 200 in biased into position within channel 322 and against wheel 118. More specifically, fastening mechanism 220 is then inserted through opening 222 such that fastening mechanism 220 contacts cover plate 200. When fastening mechanism 220 is secured against cover plate 200, cover plate inner surface 226 at outer end 326 is biased into contact against wheel surface 214 and bucket dovetails 208. Moreover, when fastening mechanism 220 is secured against cover plate 200, radially outer end 326 is biased into contact against an inner surface 314 of retainer 218.

Cover plate assembly 190 facilitates reducing leakage through gaps 212 by creating a barrier between the fluid flow path and gaps 212. More specifically, by preventing fluid from flowing through gaps 212, engine efficiency is enhanced as the fluid is channeled through rotor assembly 100 to generate power output of rotor assembly 100. Moreover, because fluid is prevented from flowing through gaps 212, the temperature of bucket dovetails 208 is facilitated to be lower than turbine assemblies in which hot fluid flows through gaps 212. As a result, cover plate assembly 190 facilitates extending rotor assembly 100 useful life while facilitating enhancing rotor assembly 100 efficiency.

FIG. 4 is a perspective view of cover plate inner surface 226. As described above, in the exemplary embodiment, cover plate assembly 190 includes a plurality of cover plates 200 coupled arcuately together end-to-end such that cover plates 200 extend substantially circumferentially against turbine wheel 118. In the exemplary embodiment, cover plate 200 includes a pair of shiplap tabs 420 and 422 that extend outward from opposite circumferential ends 416 and 418 of cover plate 200. Specifically, tabs 420 and 422 are oriented such that a shiplap tab 422 on a first cover plate 200 overlaps a shiplap tab 420 on a circumferentially adjacent second cover plate 200 to create an interface 228 between circumferentially adjacent cover plates 200. In the exemplary embodiment, each interface 228 is substantially aligned with a dovetail post 230. At each interface 228, fastening mechanism 220 is inserted through opening 222 to secure cover plate assembly 190 to wheel 118. Interface 228 facilitates preventing dovetail leakage by reducing gaps between adjacent cover plates 200 and preventing circumferential movement of cover plates 200.

Cover plate inner surface 226 includes ledge 310 and a plurality of ribs 400. The current invention is not limited to the use of ribs 400, and, alternately, devices other than ribs 400 may be used to facilitate increasing stiffness of cover plate 200. In the exemplary embodiment, ribs 400 extend a distance outward from surface 226. Cover plate 200 also includes a plurality of stiffening indentations 412 which extend a distance into surface 226. Ribs 400 extend outward from inner surface 226 above and below ledge 310. Notably, ribs 410 do not extend outward beyond an outer face 424 of ledge 310. Moreover, in the exemplary embodiment, ribs above 410 and ribs below 414 ledge 310 extend generally vertically from ledge 310 to cover plate radial edges 426 and 428, respectively. Ribs 410, 414 are substantially parallel to each other and substantially perpendicular to ledge 310. Specifically, in the exemplary embodiment, indentations 412 extend generally vertically from ledge 310 towards a radial edge 426 of cover plate 200. Moreover, in the exemplary embodiment, indentations 412 are substantially parallel to each other. Cover plate assembly 190 is coupled to wheel 118 such that ribs 400 are positioned between cover plate 200 and turbine wheel upstream surface 214. In operation, ribs 400 facilitate increasing the structural strength of cover plate 200. Ribs 400 with ledge 310 and shelf 312 facilitate circumferential locking of cover plate assembly 190. Alternatively, fastening mechanism 220 facilitates circumferential locking of cover plate assembly 190.

To couple cover plate assembly 190 to wheel 118, radially inner end 324 of cover plate 200 is inserted in inner retaining groove 318. Cover plate 200 is pivoted toward upstream surface 214 and is then slid within retaining channel 322 radially outward to position radially outer end 326 at least partially within outer retaining groove 320. In the exemplary embodiment, radially outer end 326 is positioned against a radially outer wall 328 of outer retaining groove 320. Cover plate 200 is then slid radially outward within retaining channel 322 such that cover plate ledge 310 at least partially contacts wheel shelf 312. Fastening mechanism 220 is inserted in opening 222 and is tightened until fastening mechanism contacts cover plate 200 on an outer surface 330 of radially outer end 326. When fastening mechanism 220 contacts an outer surface of radially outer end 326, an outer surface 332 of radially inner end 324 contacts an inner surface 314 of retainer 218. When rotor assembly 100 is in operation, cover plate assembly 190 is loaded against and radially retained by wheel shelf 312. Alternatively, when rotor assembly 100 is in operation, cover plate assembly 190 is loaded against and radially retained against groove 320. When rotor assembly 100 is in turning gear, cover plate assembly 190 is loaded against and radially retained by fastening mechanism 220. Alternatively, when rotor assembly 100 is in turning gear, cover plate assembly 190 is loaded against and radially retained by groove 318.

Figure 5:
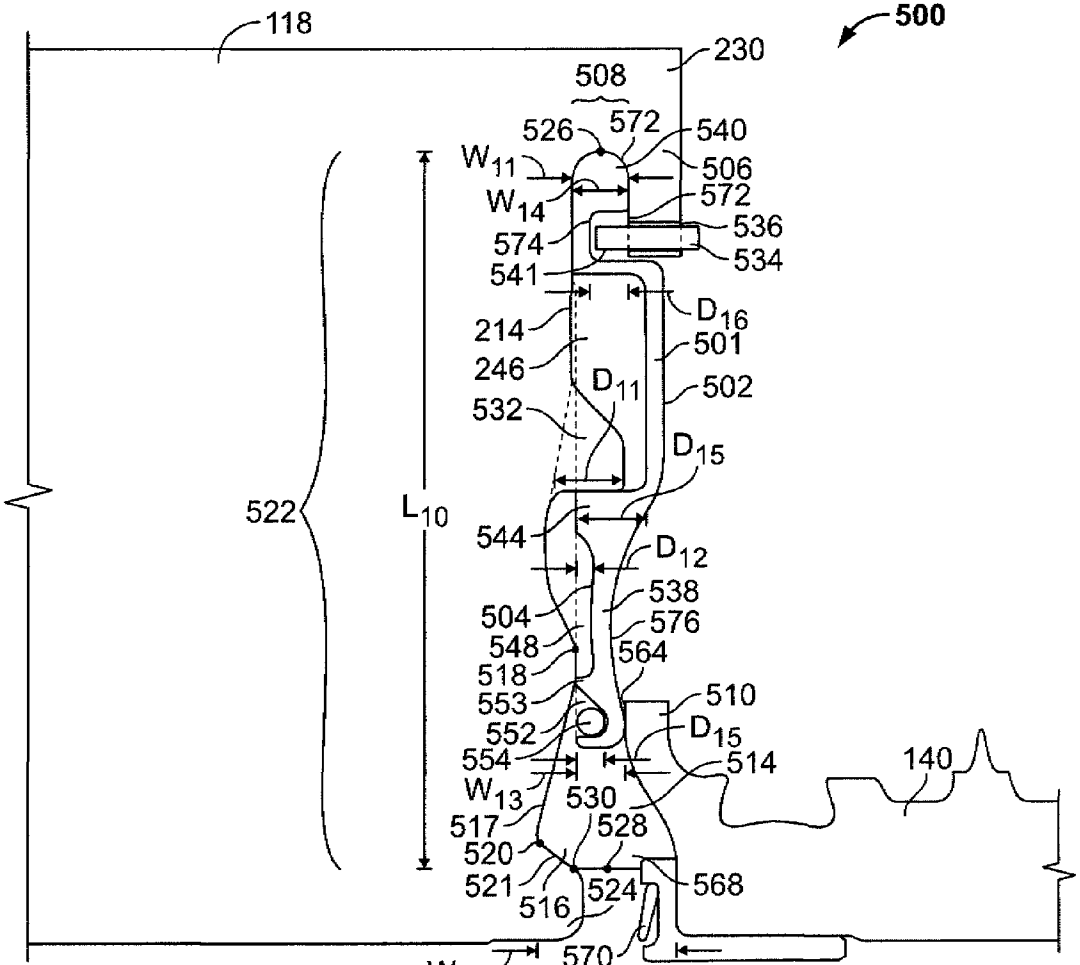
FIG. 5 is a cross-sectional view of another exemplary embodiment of a cover plate assembly that may be used with the rotor assembly shown in FIG. 1.
Figure 6:
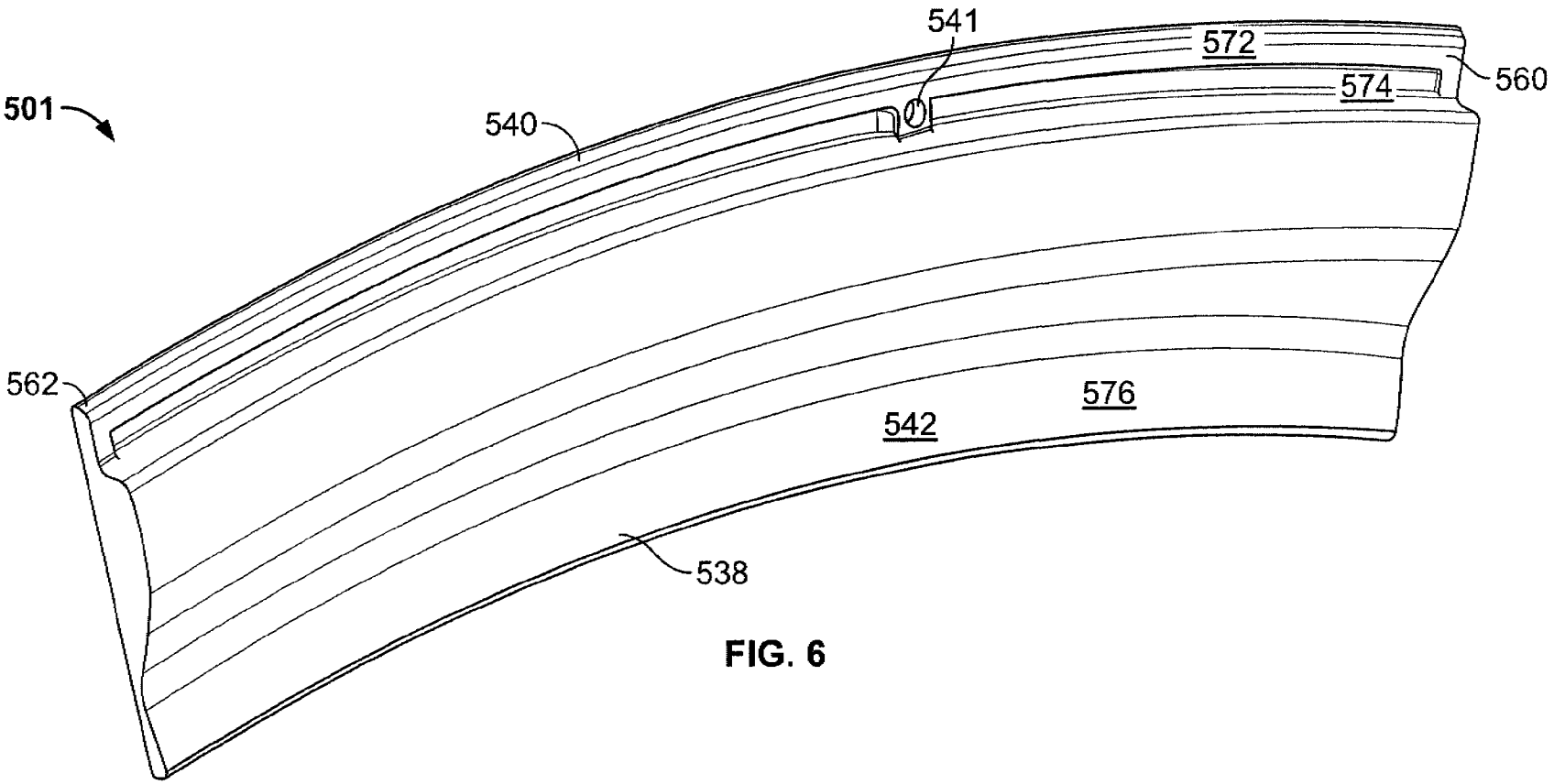
FIG. 6 is a perspective view of an upstream surface of the cover plate assembly shown in FIG. 5.
Figure 7:
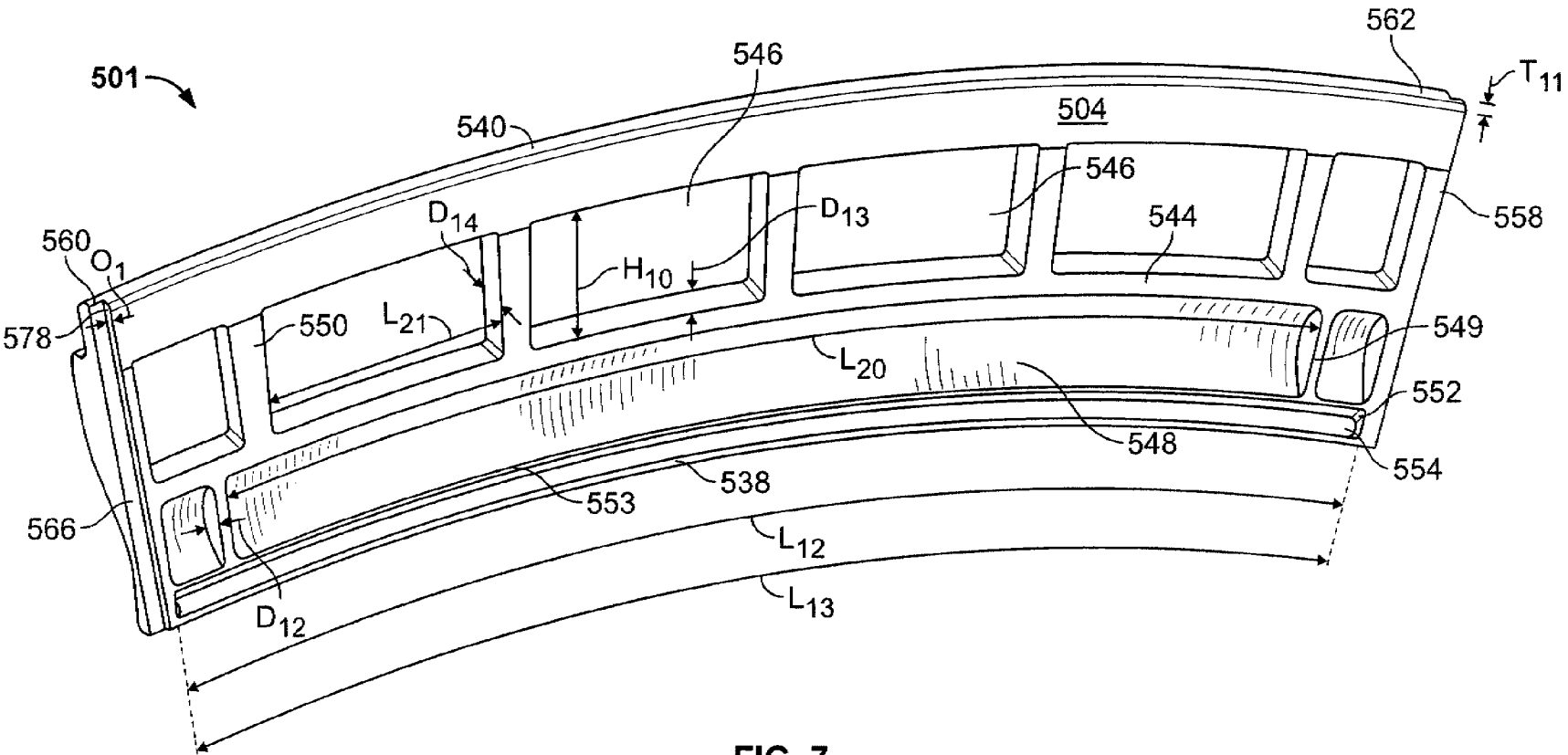
FIG. 7 is a perspective view of an inner surface of the cover plate assembly shown in FIG. 5.

FIG. 5 is a cross-sectional view of an alternate embodiment of a cover plate assembly 500 that may be used with rotor assembly 100. FIG. 6 is a perspective view of an upstream surface 502 of cover plate assembly 500. FIG. 7 is a perspective view of an inner surface 504 of cover plate assembly 500. Although illustrated as being coupled to wheel 118, it shall be appreciated by one of ordinary skill in the art that cover plate assembly 500 could be installed on, but is not limited to only being used with, any of wheels 116, 118, 120 or 122.

Buckets 126 are coupled to wheel 118 as described above. In the exemplary embodiment, each dovetail post 230 includes a projection 506 that extends inward from wheel 118 such that an outer retaining groove 508 in defined by projection 506, as described below. In an exemplary embodiment, cover plate assembly 500 is coupled to rotor assembly 100, as described herein, such that each cover plate 501 extends across each gap 212. More specifically, in the exemplary embodiment, a plurality of cover plates 501 are coupled together end-to-end such that cover plates 501 extend substantially circumferentially against one of an upstream surface 214 and a downstream surface 215 of turbine wheel 118.

In the exemplary embodiment, wheel 118 includes projections 506 and spacer 140 includes a retainer 510. Projection 506 is spaced radially outward on an upstream surface 214 of wheel 118 from retainer 510. More specifically, in the exemplary embodiment, projection 506 is formed integrally with wheel 118 and extends outward from wheel 118 such that a radially outer retaining groove 508 is defined between an inner surface 512 of projection 506 and wheel upstream surface 214. Moreover, in the exemplary embodiment, retainer 510 is formed integrally with spacer 140 and extends outward from spacer 140 such that one half of a radially inner retaining chamber 514 is formed. Alternatively, projection 506 and/or retainer 510 may be formed integrally with each of buckets 126 and with wheel 118. In another embodiment, projection 506 and/or retainer 510 may be formed integrally with each of buckets 126 and not with wheel 118. In the exemplary embodiment, chamber 514 is closed at a radially inner end 568 by a seal 570 extending between wheel 118 and spacer 140. Alternatively, chamber 514 is not sealed at end 568. The remainder of retaining chamber 514 is defined by a depression 516 formed on wheel upstream surface 214. Depression 516 is defined by a first face 517 and a second face 521. First face 517 is extends obliquely from a point 518 on upstream surface 214 to a point 520 radially inward from point 518. Second face 521 extends obliquely outward from point 520 to a point 530 on upstream surface 214 that is substantially co-planar with point 518. Depression 516 and retaining chamber 514 are partially bordered by an annular flange 524. Annular flange 524 is substantially co-planar with upstream surface 214 and extends circumferentially about wheel 118. More specifically, in the exemplary embodiment, annular flange 524 is substantially co-planar with point 518 and is radially inward of point 520.

Retaining groove 508 has a width $W_{11}$, and retaining chamber 514 has a width $W_{12}$. Chamber width $W_{12}$, is sized to enable cover plate 501 to be slidably inserted in chamber 514 and pivoted into position against wheel 118. In the exemplary embodiment, groove 508 and chamber 514 are aligned generally radially. More specifically, a retaining channel 522 extends from groove 508 to chamber 514. Retaining channel 522 has a length $L_{10}$, that extends radially from a radially outermost point 526 of groove 508 to a point 528 defined in chamber 514 that is at the approximately same radial distance as point 530. Point 530 represents the radially outermost portion of annular flange 524 that is substantially co-planar with point 518. Cover plate 501 is retained within retaining channel 522, as described below.

In the exemplary embodiment, within retaining channel 522, wheel 118 includes a shelf 532 that is formed integrally on wheel upstream surface 214. More specifically, shelf 532 has a length $L_{11}$ (not shown), measured circumferentially along wheel upstream surface 214 and a depth $D_{11}$, measured generally axially outward from wheel upstream surface 214. In the exemplary embodiment, length $L_{11}$ is such that shelf 532 extends only across a portion of wheel 118, and more specifically, extends only partially between adjacent retaining slots 210.

In the exemplary embodiment, cover plate assembly 500 includes at least one cover plate 501 and at least one fastening mechanism 534 that is sized to be received in an opening 536 defined in turbine wheel 118. In the exemplary embodiment, opening 536 extends through projection 506. Fastening mechanism 534 is inserted through opening 536 to secure cover plate 501 to wheel 118. In the exemplary embodiment, fastening mechanism 534 is a threaded bolt. It will be appreciated by one in the art that any suitable coupling mechanism or component, such as a bolt, a screw, a pin, an axial bolt, a stud, or a threaded rod, may be used as fastening mechanism 534. Welding may also be used as fastening mechanism 534; however, using retention hardware facilitates subsequent cover plate assembly 500 disassembly for maintenance or other purposes.

Cover plate 501 includes a radially inner end 538, a radially outer end 540, and a body 542 extending therebetween. Cover plate ends 538 and 540 each have a width $W_{13}$ and $W_{14}$, respectively. Width $W_{14}$ is sized to enable cover plate end 540 to be inserted within retaining groove 508. More specifically, in the exemplary embodiment, width $W_{13}$ is narrower than widths $W_{11}$ and $W_{14}$, and width $W_{14}$ is narrower than width $W_{12}$. An indention 541 is defined in outer end 540. Indention 541 has a depth $D_{16}$ and is sized to receive fastening mechanism 534, as described in more detail below.

Furthermore, in the exemplary embodiment, cover plate 501 is formed integrally with a ledge 544 defined on an inner surface 504 of cover plate 501. In the exemplary embodiment, ledge 544 is defined between a radially outer depression 546 and a radially inner channel 548. In the exemplary embodiment, channel 548 is at least partially concave and has a depth $D_{12}$. Channel 548 extends circumferentially along inner surface 504 radially inward of ledge 544 and, in the exemplary embodiment, includes a plurality of ribs 549. Each rib 549 is substantially co-planar with ledge 544 and is spaced a length $L_{20}$ apart. Furthermore, in the exemplary embodiment, depression 546 has depth $D_{13}$, a length $L_{13}$, and a height $H_{10}$. Length $L_{13}$ is approximately equal to length $L_{12}$. In the exemplary embodiment, ribs 550 are circumferentially-spaced a distance $L_{21}$ apart in depression 546, and each rib 550 has a depth of $D_{14}$. In the exemplary embodiment, length $L_{21}$ is less than $L_{20}$, such that there are more ribs 550 than ribs 549. In the exemplary embodiment, depth $D_{14}$ is approximately equal to depth $D_{13}$. Moreover, in the exemplary embodiment, ribs 550 are co-planar with ledge 544. When cover plate assembly 500 is coupled to wheel 118, ribs 549 and 550 are between upstream surface 214 and cover plate 501. Ribs 549 and 550 facilitate increasing the structural strength of cover plate 501. Ribs 549 and 550 cooperate with ledge 544 and shelf 532 to facilitate circumferential locking of cover plate assembly 500. Alternatively, fastening mechanism 534 facilitates circumferential locking of cover plate assembly 500. The current invention is not limited to the use of ribs 549 and 550, and, alternately, devices other than ribs 549 and 550 may be used to facilitate increasing stiffness of cover plate 200.

Inner surface 504 also includes a groove 552 defined radially inward of channel 548. Groove 552 has a partially cylindrical cross-section with a depth $D_{15}$, and has a protrusion 553 defining a portion of groove 552. Depth $D_{15}$ is sized to receive a damper 554 therein. Damper 554 is maintained in position between cover plate 501 and wheel 118 by groove 552. Protrusion 553 contacts wheel upstream surface 214 when cover plate 501 is positioned against wheel 118. Damper 554 deforms during rotor assembly 100 operation when subjected to centripetal forces that cause damper 554 to shift radially outward against protrusion 553, such that a seal is formed between wheel 118 and cover plate 501. Damper 554 and protrusion 553 also force radially inner end 538 toward retainer 510 such that a seal between cover plate 501 and retainer 510 is formed. In the exemplary embodiment, damper 554 is a seal wire.

To couple cover plate assembly 500 to wheel 118, cover plate radially inner end 538 is inserted in retaining chamber 514. Cover plate 501 is pivoted toward upstream surface 214 and is then slid radially outward within retaining channel 522 until radially outer end 540 is positioned at least partially within outer retaining groove 508. In the exemplary embodiment, radially outer end 540 is positioned against a radially outer wall 572 of outer retaining groove 508. Furthermore, cover plate 501 is slid radially outward within retaining channel 522 such that cover plate ledge 544 at least partially contacts wheel shelf 532. Fastening mechanism 534 is inserted in opening 536 such that fastening mechanism 534 contacts cover plate 501 on an outer surface 574 of radially outer end 540. In the exemplary embodiment, at least one fastening mechanism 534 is at least partially received within indentation 541. When fastening mechanism 534 contacts an outer surface 574 of radially outer end 540, an outer surface 576 of radially inner end 538 contacts an inner surface of spacer retainer 510.

In the exemplary embodiment, cover plate assembly 500 includes a plurality of cover plates 501 coupled arcuately together end-to-end such that cover plates 501 extend substantially circumferentially against turbine wheel 118. In the exemplary embodiment, cover plate 501 includes a pair of shiplap tabs 556 and 558 that extend outward from opposite circumferential ends 560 and 562 of cover plate 501. In the exemplary embodiment, length $L_{12}$ extends between circumferentially-adjacent shiplap tabs 556 and 558 formed on each circumferential end 560 and 562 of cover plate 501. Shiplap tab 556 is counter-bored to enable an offset 578 of depth $O_{11}$ to be formed in inner surface 504. Shiplap tab 558 has a thickness, $T_{11}$. In the exemplary embodiment $T_{11}$ is approximately equal to depth $O_{11}$ such that shiplap tab 558 is configured to mate with shiplap tab 556 of an adjacent cover plate 501. Specifically, tabs 556 and 558 are oriented such that a shiplap tab 556 on a first cover plate 501 overlaps a shiplap tab 558 on a circumferentially adjacent second cover plate 501 to create an interface 566 between circumferentially adjacent cover plates 501. In the exemplary embodiment, each interface 566 is substantially aligned with a dovetail post 230. At each interface 566, fastening mechanism 534 is inserted through opening 536 to secure cover plate assembly 500 to wheel 118. Interface 566 facilitates preventing dovetail leakage by reducing gaps between adjacent cover plates 501 and preventing circumferential movement of cover plates 501.

Cover plate assembly 500 is secured to wheel 118 in retaining channel 522 by initially inserting a portion of cover plate radially inner end 538 into a portion of retaining chamber 514. Cover plate radially outer end 540 is slidably inserted into retaining groove 508 such that ledge 544 contacts shelf 532. More specifically, in the exemplary embodiment, when outer end 540 is slidably inserted into outer retaining groove 508, cover plate ledge 544 engages wheel shelf 532 such that cover plate 501 in biased into position within channel 522 and against wheel 118. More specifically, fastening mechanism 534 is then inserted through opening 536 such that fastening mechanism 534 contacts cover plate 501. In the exemplary embodiment, a plurality of fastening mechanisms 534 are used to retain cover plate 501 in position, and at least one of the plurality of fastening mechanism is received in indentation 541. When fastening mechanism 534 is secured against cover plate 501 in indentation 541, cover plate 501 is circumferentially secured to wheel 118. Furthermore, when fastening mechanism 534 contacts cover plate outer end 540, cover plate inner surface 504 at outer end 540 is biased into contact against wheel surface 214 and bucket dovetails 208. Moreover, when fastening mechanism 534 is secured against cover plate 501, radially outer end 540 is biased into contact against an inner surface 564 of retainer 510.

When rotor assembly 100 is in operation, cover plate assembly 500 is loaded against and radially retained by wheel shelf 532. Alternatively, when rotor assembly 100 is in operation, cover plate assembly 500 is loaded against and radially retained against groove 508. When rotor assembly 100 is in turning gear, cover plate assembly 500 is loaded against and radially retained by fastening mechanism 534.

Cover plate assembly 500 facilitates reducing leakage through gaps 212 by creating a barrier between the fluid flow path and gaps 212. More specifically, by preventing fluid from flowing through gaps 212, engine efficiency is enhanced as the fluid is channeled through rotor assembly 100 to generate power output of rotor assembly 100. Moreover, because fluid is prevented from flowing through gaps 212, the temperature of bucket dovetails 208 is facilitated to be lower than turbine assemblies in which hot fluid flows through gaps 212. As a result, cover plate assembly 500 facilitates extending rotor assembly 100 useful life while facilitating enhancing rotor assembly 100 efficiency.

The above-described apparatus facilitates increasing turbine efficiency and power output by reducing dovetail leakage through gaps formed between bucket dovetails and turbine wheel retaining slots. The cover plate assembly covers substantially all of the gaps, such that fluid is prevented from being diverted from the nozzles and the buckets. The seal between the cover plate and the turbine wheel is facilitated to be enhanced by the centrifugal forces of the rotation of the wheel and cover plate assembly that act on the cover plate. The interface formed between adjacent cover plates further facilitates preventing dovetail leakage by reducing gaps between adjacent cover plates. The cover plate interfaces are positioned at dovetail post projections such that double shear loading facilitates increasing axial bucket retention and facilitates reducing dovetail leakage. Further, the apparatus increases the amount of air available for purging of wheel space buffers and trench cavities. The air that flows across the dovetails to purge wheel spaces can be metered when the apparatus is used. The apparatus also acts as a bucket dovetail retainer by biasing the cover plate assembly against the bucket dovetails coupled to the turbine wheel. As described, the cover plate assembly is field installable on turbines and does not impact current bucket design. Furthermore, the ribs add structural strength to the cover plate for frequency requirements. The ribs also facilitate reducing windage and aid in cooling the buckets.

Exemplary embodiments of a method and apparatus to facilitate increasing turbine rotor efficiency are described above in detail. The apparatus is not limited to the specific embodiments described herein, but rather, components of the method and apparatus may be utilized independently and separately from other components described herein. For example, the cover plate assembly may also be used in combination with other turbine engine components, and is not limited to practice with only turbine wheel assemblies as described herein. Rather, the present invention can be implemented and utilized in connection with many other fluid leakage reduction applications.

While the invention has been described in terms of various specific embodiments, those skilled in the art will recognize that the invention can be practiced with modification within the spirit and scope of the claims.

What is claimed is:

1. A method of assembling a turbine, said method comprising:

coupling a plurality of buckets that each include a dovetail to a turbine wheel, wherein the turbine wheel includes a plurality of retaining slots defined therein that are sized to receive each of the plurality of bucket dovetails therein, the turbine wheel also includes at least one projection extending outward from the turbine wheel and a shelf formed thereon;

coupling a first end of a cover plate to the turbine wheel such that the at least one projection retains the cover plate in a position relative to the turbine wheel;

inserting a fastening mechanism through an opening defined in the turbine wheel to secure the cover plate against the turbine wheel such that the cover plate facilitates reducing dovetail leakage across the plurality of buckets coupled to the turbine wheel adjacent to the cover plate; and biasing, via the shelf, a second end of the cover plate in sealing contact against the turbine wheel, such that an outer surface of the cover plate contacts an inner surface of at least one of at least one retainer extending from the turbine wheel and at least one retainer extending from an adjacent turbine component.

2. A method in accordance with claim 1 wherein inserting a fastening mechanism through an opening defined in the turbine wheel comprises inserting the fastening mechanism through an opening defined in the at least one wheel projection.

3. A method in accordance with claim 1 further comprising:

positioning the second end of the cover plate adjacent the turbine wheel such that the cover plate extends over at least a portion of the plurality of buckets; and coupling the cover plate to the turbine wheel such that the second end-of the cover plate is biased into contact with at least one of the at least one retainer extending from the turbine wheel and at least one retainer extending from an adjacent turbine component.

4. A method in accordance with claim 1 further comprising biasing a dampening mechanism coupled to the second end of the cover plate in sealing contact against the turbine wheel.

5. A method in accordance with claim 1 wherein biasing a second end of the cover plate comprises positioning a ledge formed on the cover plate against the shelf formed on the turbine wheel.

6. A method in accordance with claim 1 wherein coupling a first end of a cover plate to the turbine wheel further comprises coupling the cover plate to the turbine wheel such that a plurality of ribs formed on an inner surface of the cover plate extend between the turbine wheel and the outer surface of the cover plate.

7. A turbine comprising:

a plurality of buckets each comprising a dovetail;

a turbine wheel comprising a plurality of retaining slots defined therein, each of said plurality of retaining slots is sized to receive each of said plurality of bucket dovetails therein, said turbine wheel further comprising at least one projection extending outward from said turbine wheel and a shelf formed on said turbine wheel;

at least one cover plate coupled to said turbine wheel such that said at least one projection retains said cover plate in position against said turbine wheel; and at least one fastening mechanism inserted through an opening defined in said turbine wheel to secure said cover plate to said turbine wheel such that said cover plate facilitates reducing dovetail leakage across said plurality of buckets adjacent to said cover plate, said shelf biases said cover plate against said turbine wheel such that an outer surface of said cover plate contacts an inner surface of at least one of at least one retainer extending from said turbine wheel and at least one retainer extending from an adjacent turbine component.

8. A turbine in accordance with claim 7 wherein said shelf is configured to engage a ledge defined on said cover plate when said cover plate is secured to said turbine wheel.

9. A turbine in accordance with claim 7 wherein an inner surface of said cover plate comprises a plurality of ribs configured to facilitate enhancing a structural strength of said cover plate.

10. A turbine in accordance with claim 7 wherein said turbine further comprises a dampening mechanism extending from said cover plate to said wheel.

11. A turbine in accordance with claim 7 wherein a plurality of said cover plates extend substantially circumferentially against one of an upstream surface and a downstream surface of said turbine wheel.

12. A wheel assembly for use with a turbine, said wheel assembly comprising:

a turbine wheel comprising a plurality of retaining slots defined therein and at least one projection, each of said plurality of slots is sized to receive a turbine bucket therein, said at least one projection extends outward from said turbine wheel and comprises at least one opening extending therethrough, said turbine wheel further comprises a shelf formed thereon;

at least one cover plate configured to couple to said turbine wheel such that said at least one projection retains said at least one cover plate in position against said turbine wheel; and at least one fastening mechanism sized for insertion through said at least one opening to secure said cover plate against said turbine wheel such that said cover plate extends across at least one of said plurality of retaining slots, said shelf biases said cover plate against said turbine wheel such that an outer surface of said cover plate contacts an inner surface of at least one of at least one retainer extending from said turbine wheel and at least one retainer extending from an adjacent turbine component.

13. A wheel assembly in accordance with claim 12 wherein said shelf is configured to engage a portion of said cover plate when said cover plate is secured to said turbine wheel.

14. A wheel assembly in accordance with claim 13 wherein said at least one fastening mechanism is configured to secure said cover plate against said turbine wheel shelf and against said inner surface of at least one of said at least one retainer extending from said turbine wheel and said at least one retainer extending from an adjacent turbine component.

15. A wheel assembly in accordance with claim 12 wherein said at least one cover plate further comprises a plurality of ribs extending across an inner surface of said cover plate, said plurality of ribs facilitate enhancing a structural strength of said cover plate.

16. A wheel assembly in accordance with claim 12 wherein said assembly further comprises a plurality of said turbine wheels, said cover plate is coupled to at least one upstream surface of at least one of said plurality of said turbine wheels.

17. A wheel assembly in accordance with claim 12 wherein said assembly further comprising a plurality of said cover plates coupled circumferentially together end-to-end such that said plurality of said cover plates extend circumferentially against said turbine wheel.

18. A wheel assembly in accordance with claim 12 wherein said wheel assembly further comprises a dampening mechanism extending from said cover plate to said wheel.

* * * * *